United States Patent [19]

Foreman et al.

[11] 4,149,702

[45] Apr. 17, 1979

[54] METHOD AND APPARATUS FOR RECYCLING HEAT TREATING SALTS

[75] Inventors: Robert W. Foreman, Bloomfield Hills; Gajen P. Dubal, Sterling Heights, both of Mich.

[73] Assignee: Park Chemical Company, Detroit, Mich.

[21] Appl. No.: 818,382

[22] Filed: Jul. 25, 1977

Related U.S. Application Data

[62] Division of Ser. No. 670,152, Mar. 25, 1976, abandoned.

[51] Int. Cl.[2] ..... C21D 1/46

[52] U.S. Cl. ..... 266/114; 266/120

[58] Field of Search ..... 23/274, 275; 148/15, 148/15.5, 20, 27, 28; 159/45; 266/114, 120

[56] References Cited

U.S. PATENT DOCUMENTS

| | | | |
|---|---|---|---|
| 3,645,802 | 2/1972 | Keough | 266/120 X |
| 3,793,208 | 2/1974 | Foreman | 148/15 X |
| 3,847,597 | 11/1974 | Mueller et al. | 148/15.5 |
| 3,953,508 | 4/1976 | Coch | 148/15 |
| 3,966,508 | 6/1976 | Mohr | 148/15 |
| 4,066,477 | 1/1978 | Böckenhofl et al. | 266/107 |

*Primary Examiner*—Roy Lake
*Assistant Examiner*—Paul A. Bell
*Attorney, Agent, or Firm*—Krass & Young

[57] ABSTRACT

A system for recycling heat treating salts such as nitrates and nitrites from a rinse bath including means to prevent the excessive build-up of impurities such as carbonates which impair heat treat efficiency. For example, carbonates which form in a nitrate-nitrite quench bath are removed by concentrating the rinse water, rectifying the concentrate and returning molten rectified salt to the quench.

11 Claims, 1 Drawing Figure

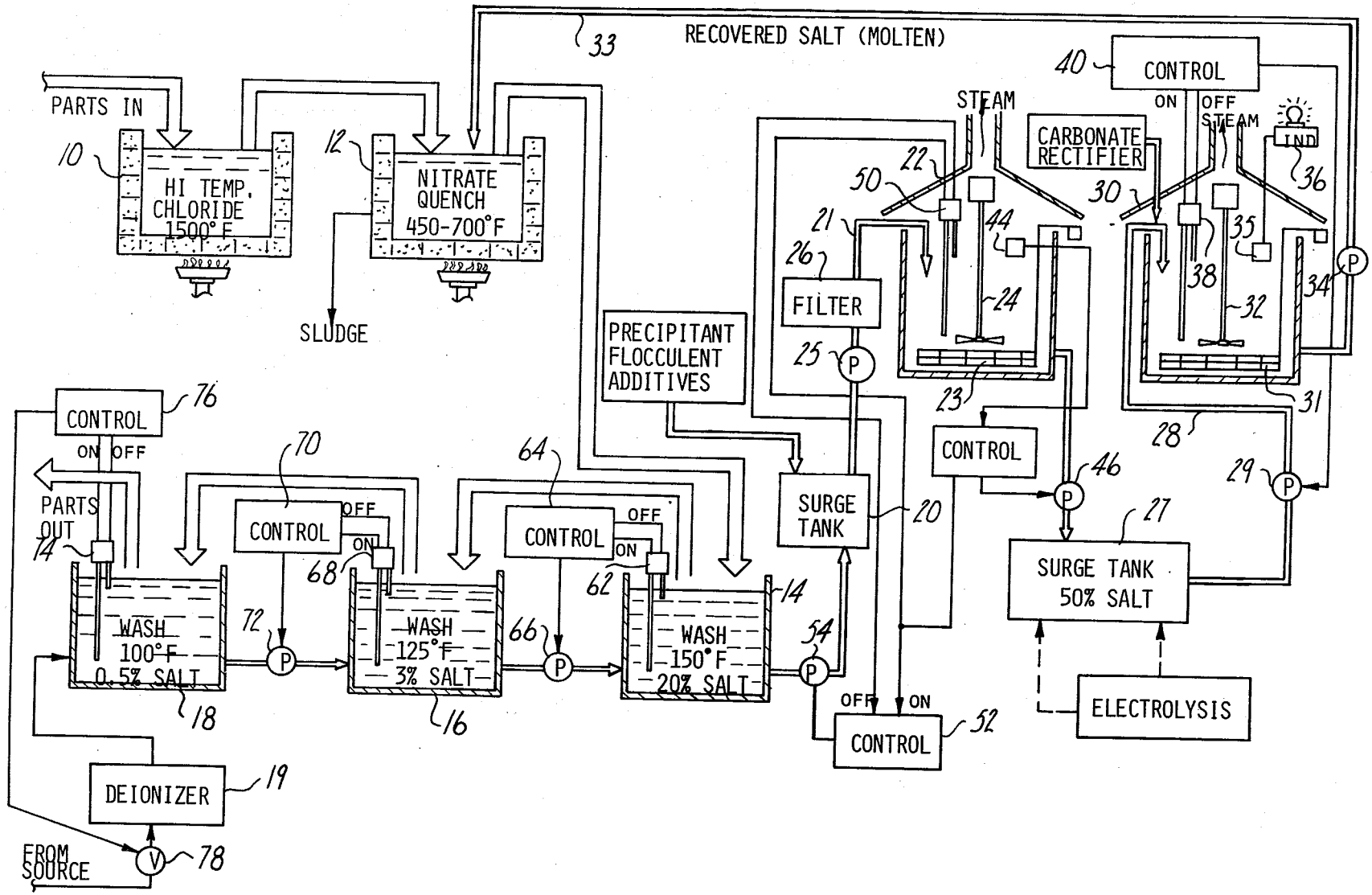
RECOVERED SALT (MOLTEN)
CONTROL
ON
OFF
STEAM
IND
CARBONATE RECTIFIER
STEAM
FILTER
SURGE TANK
SURGE TANK 50% SALT
ELECTROLYSIS
CONTROL
CONTROL
CONTROL
PRECIPITANT FLOCCULENT ADDITIVES
WASH 150°F 20% SALT
WASH 125°F 3% SALT
WASH 100°F 0.5% SALT
NITRATE QUENCH 450-700°F
HI TEMP. CHLORIDE 1500°F
SLUDGE
PARTS IN
PARTS OUT
DEIONIZER
FROM SOURCE

METHOD AND APPARATUS FOR RECYCLING HEAT TREATING SALTS

This is a division, of application Ser. No. 670,152, filed Mar. 25, 1976 now abandoned.

INTRODUCTION

This invention relates to methods and apparatus for recycling water soluble heat treating salts from a rinse bath into which the salts are introduced by drag-out from a heat treating bath. In particular, the invention relates to the effective prevention of the build-up of impurities and undesirable reaction products such as chlorides and carbonates in the heat treating bath due to the salt recycling.

As used herein the term "heat treating" refers to processes such as heating and quenching for the purpose of altering physical characteristics of a metal, and excludes material deposition processes such as electroplating.

BACKGROUND OF THE INVENTION

Commercial hardening techniques for ferrous metal components typically involve the steps of heating the components in a furnace or a bath of molten salt, such as a chloride, quenching the components in a bath of another molten salt such as a nitrate, nitrite, or mixture thereof, and thereafter causing the parts to be passed through one or more rinse baths to clean off salts which cling to the parts as a result of the heating and quenching steps. A certain amount of each of the molten salts is transferred by drag-out to the rinse bath, thus requiring occasional replenishment of the molten salts, as well as replacement of the rinse water.

It is desirable to recover the salts from the rinse water and return them to the heat treating baths. However, a number of problems have heretofore prevented such recycling on a straightforward and economical basis. First, it is difficult to justify economically the installation of recovery apparatus unless the quantities of reclaimed salts are very high, and the recovery process can be carried out without shut-down of the heat treating system. Secondly, it has been found that the impurities which typically find their way into heat treating baths tend to build up to unacceptable levels particularly fast when the salts are recovered from the rinse and recycled into the heat treat bath. For example, chloride salts from a heating bath are dragged into the quench bath and thence into the rinse where recycling tends to return them to the quench bath. Recycled chloride impurities quickly reach insolubility levels in the quench, and crystallize out as a sludge which must be removed from time to time. In addition, chloride tends to substantially reduce the quench efficiency of a nitrate/nitrite bath and, thus, removing the chlorides is highly desirable.

Another impurity which will build up quickly as a result of salt recycling is carbonate, a reaction product of decomposition of the salt itself. For example, a sodium nitrate/nitrite salt tends to form $Na_2CO_3$, the carbon being taken out of the $CO_2$ present in the air. The sodium carbonate is quite soluble in the rinse water but only sparingly soluble in the nitrate/nitrite quench bath and, thus forms a precipitate in the bath which impairs quenching efficiency and coats mechanical components in contact with the bath.

It should be understood that both the chloride and carbonate impurities, as well as many other impurities such as hard water ions, are typically present in the heat treating salt baths of prior art systems. However, the levels of concentration of such impurities are kept reasonably and acceptably low for longer periods of use by reason of the fact that impurities as well as desirable salts are continuously lost by drag-out. Lost salt, of course, is replaced by fresh salt which does not contain the impurities. Where salt is recycled, however, undesirable impurities dragged into the rinse and which are soluble in the rinse water are retained in the recycled materials and, after a short time, reach unacceptable concentrations.

BRIEF SUMMARY OF THE INVENTION

The present invention provides both method and apparatus for recycling water soluble heat treating salts, typically by reclaiming such salts from a rinse bath and returning them to the heat treating bath in such form as to prevent the build-up of undesirable impurities such as chlorides and reaction products from decomposition of the original heat treating salts. Moreover, the invention provides for such recycling in an economical and practical fashion.

In general, the method of recycling the water soluble heat treating salt from a rinse bath into which the salt has been introduced by drag-out from a molten salt heat treating bath comprises the steps of concentrating the rinse water and salt solution with the impurities therein, treating the concentrate to remove the impurities and returning the salt to the heat treating bath, all of such steps being performed on the salt in a fluidic state, either because it is in solution or molten.

An apparatus for recycling water soluble quenching salts from rinse water may comprise, in combination: a quench bath of molten nitrate/nitrite salt; a rinse bath located in proximity to the quench bath for receiving parts therefrom and containing a fluid such as water; means for concentrating the rinse water and salt solution with impurities therein, means for treating the concentrated rinse fluid for the effective elimination of the impurities, and means for returning the treated salt in a molten condition to the quench bath.

The invention is set forth hereinafter with reference to specific examples, the first of which involves a substantially continuous process and apparatus for recycling nitrate/nitrite salts for use in a quenching bath, and particularly for the removal of carbonates which are formed as a product of reaction with carbon dioxide in the air. In the preferred form the treatment for removal of the carbonate involves nitric acid rectification performed on a highly concentrated molten salt under closely controlled conditions of temperature and chemical composition.

The invention as well as the various additional features and advantages thereof will be best understood from a reading of the following specification which describes the best known mode of practicing the invention and is to be taken with the accompanying drawing.

BRIEF DESCRIPTION OF THE DRAWING

The single FIGURE is a schematic diagram of a system embodying the invention for recycling nitrate/-nitrite salts from a rinse tank to a molten quenching bath by counterflow and evaporative concentration, and acidic rectification to remove carbonate impurities.

DETAILED DESCRIPTION OF SPECIFIC EMBODIMENTS

The drawing shows a typical heat treating arrangement for hardening ferrous metal parts, and a specific, illustrative embodiment of the invention as applied to the recovery and recycling of nitrate/nitrite salts from a quench bath. In the drawing the parts are heated by immersion in a molten chloride contained in a gas-fired refractory furnace 10. It will be understood that the furnace 10 could also be an atmospheric furnace as far as the effect of heat treatment is concerned. After heating to approximately 1500° F. in the chloride bath, the parts are transferred to a refractory quench furnace 12 containing a bath of molten salt such as a sodium nitrate/nitrite mixture maintained in a molten condition at a temperature of about 475° F. to about 700° F. Furnace 12 is also typically gas-fired. The metallurgical result of heating and quenching ferrous metal parts is well known and will not be described herein.

From the quench bath 12 the parts are removed to an open rinse tank 14 containing water at approximately 150° F. for the purpose of rinsing off salts which are dragged from the quench bath 12 by the parts under treatment as well as the carrier apparatus for the parts. Typically, the quench bath and the rinse tank are located in close physical proximity to one another such that a substantial portion of the molten salt dragged out of the bath 12 on the parts finds its way to the rinse tank 14. The parts thereafter may go through a sequence of additional interconnected open rinse tanks 16 and 18 containing water at temperatures of 125° F. and 100° F., respectively, where substantially all the remaining salts clinging to the parts and carriers are washed away. The sequential rinse results in gradually decreasing salt content in the rinse water of baths 14, 16 and 18 as is indicated in the drawing.

It can be seen that some quantity of chloride salt from the heating furnace 10 is dragged into the nitrate/nitrite salt quench bath where it is regarded as an impurity. The chloride, and other impurities, are removed to the rinse tank 14 by drag-out and are dissolved in the rinse water along with the nitrate/nitrite salts which are to be recovered.

The first step in the recovery process involves concentrating the rinse water salt/impurities solution. This is accomplished in two ways. First, a countercurrent flow system is connected between rinse tanks 14, 16 and 18 such that the highest concentration of recoverable salt exists in tank 14. Fresh water enters tank 18 through a de-ionizer 19. Tank 18 overflows into tank 16 which, in turn overflows into tank 14. It will be understood that the term "overflows" is not necessarily to be construed literally for, although a system of weirs and gravity flow channels can be used, the illustrated embodiment employs electronic level detectors and controlled pumps as hereinafter described.

After achieving a recoverable salt concentration in tank 14 of about twenty percent, the solution is transferred from tank 14 to a surge tank 20 which is preferably closed and of a capacity at least as great as that of the rinse tank 14.

From surge tank 20, the rinse water salt/impurity solution is transferred through a fluid circuit 21 to a hooded concentrator 22 for further concentration by evaporation of the rinse water. A concentrate of approximately 50% salt can be achieved by maintaining a uniform temperature in the solution of about 240° F. to about 250° F. An over-the-side electric immersion heater 23 and an air-motor driven agitator 24 are employed for this purpose.

Fluid circuit 21 comprises, in addition to conduit of a suitable non-corrosive material such as Inconel, a pump 25 and a filter 26 which removes foreign matter such as scale.

After achieving the 50% concentration in unit 22, the solution is transferred into a second, closed surge tank 27 of a capacity about three to four times that of the unit 22. From surge tank 27, the 50% solution is transferred through fluid circuit 28 containing pump 29 to a hooded melter unit 30 which is similar to unit 22 but which operates at a higher temperature for reasons to be described. Melter unit 30 comprises an electric immersion heater 31 and an air motor driven agitator 32 to maintain uniform temperature throughout the contents thereof.

Melter unit 30 is connected via a controlled fluid circuit 33 to the nitrate/nitrite bath 12 for the return of molten salt thereto.

EXAMPLE I - NITRATE RECOVERY WITH CARBONATE IMPURITY REMOVAL

In the first specific example of operation, it will be assumed that the salt to be recovered is sodium nitrate, it being understood that the typical quench bath utilizes a mixture of potassium nitrate and sodium nitrite. It should further be understood that sodium nitrate is merely representative of the salts which may be used in commercial heat treating baths; other salts are potassium nitrate, potassium nitrite, lithium nitrate, lithium nitrite, magnesium nitrate, strontium nitrate and others. It will be further assumed that the principal impurity to be removed from the salt before recycling is sodium carbonate, formed as a product of salt decomposition wherein the carbon is derived from carbon dioxide in the air. As will be appreciated by those skilled in the art, air in the vicinity of high temperature heat treating operations is typically rich in $CO_2$.

Sodium carbonate ($Na_2CO_3$) is formed in the quench bath 12 where it is only sparingly soluble. Once the concentration of carbonate exceeds the level of solubility in bath 12, the carbonate not only substantially interferes with quench efficiency but clings to and coats the apparatus associated with the bath. A substantial operating improvement can be realized by removing the carbonate from the salt which is recovered from the rinse and recycled back to the quench.

The preferred treatment for effective removal of carbonates is known as rectification and is preferably performed in the melter unit 30 after the concentrate has reached a uniform temperature of about 400° F. and all water has been driven off. At this point, rectification is achieved by introducing into the concentrate an aqueous solution consisting of about 0.1 percent to about eight percent by weight free nitric acid, about 0.01 percent to about five percent by weight a non-ionic surfactant for detering foaming and for assisting in rapid dispersion of the nitric acid solution in the bath, and the balance water. The temperature of the concentrate must be maintained in the range of about 300° F. to about 600° F. during the rectificaton process. This treatment has been found to provide good results in rectifying the concentrate, the reaction products being the original sodium salt, and carbon dioxide which is evacuated by the unit 30.

The nitric acid content of the aqueous solution referred to above should preferably be maintained within the range of two percent to about seven percent and best results are obtained within the range of about four percent to about six percent free nitric acid by weight of said aqueous solution. The surfactant used in the treatment should be non-ionic, low foaming and soluble in water and stable to dilute aqueous acids such as nitric acid. The surfactant should preferably be composed of carbon, hydrogen and oxygen to avoid undesirable residues in the rectified salt such as phosphates or sulfates. Satisfactory surfactants for rectification purposes are available from Wyandotte Chemical Company and may be described as condensates of ethylene oxide with hydrophobic bases formed by condensing propylene oxide with propylene glycol. The Wyandotte Chemical Company trade name is Pluronic F68LF. Other usable agents are available from: GAF Corporation under the trade name Igepal CO 610, Olin Corporation under the trade name Poly-Tergent LF-405, Rohm and Haas Company under the trade name Triton CF-21, and Union Carbide Corporation under the trade name Tergitol Min-Foam. These constituents in the aqueous solution will effectively convert, i.e. convert back into the salt and $CO_2$, carbonate impurities which are salts of sodium, potassium, magnesium, lithium, strontium and others normally present in the commercial salt bath from about 0.01 percent to about three percent by weight.

EXAMPLE II - REMOVAL OF CARBONATE IMPURITY BY PRECIPITATION AND FLOCCULATION

The removal of sodium carbonate from the rinse water in the partially concentrated bath of tank 14 can also be accomplished by precipitation. This process is preferably carried out in a separate container between the rinse tank 14 and the concentrator 22 such that the resulting precipitates neither interfere with the continuous operation of the heat treating plant nor collect on and foul the operation of various physical elements so as to require extraordinary maintenance thereof. In the following example it will be assumed that the steps of precipitation and flocculation are carried out in the surge tank 20.

The first step is to add a precipitant such as calcium nitrate to the partially concentrated rinse water salt/impurity solution. The resulting precipitate tends to be fairly fine and accordingly a flocculant such as a polyacrylamide is added. A suitable flocculant is available from the Hercules Chemical Company and is sold under the trade name Hercofloc. Once flocculated, the precipitate may be filtered in unit 26 by conventional mechanical means for elimination from the concentrate. Alternatively, the precipitate may be centrifuged or removed simply by allowing it to settle to the bottom of the surge tank 20 where it may be periodically removed.

EXAMPLE III - ELIMINATION OF CHLORIDE

Where a molten chloride bath is used to heat the ferrous parts prior to quench, as shown in the drawing, it is inevitable that chloride salts are dragged into the quench bath. After a time the chloride content exceeds the level of solubility in the quench bath and crystallizes out to form a sludge which must be periodically removed. Dissolved and undissolved chloride is carried out by the parts and carriers to the rinse tank 14 where it is dissolved in the rinse water along with the nitrate to be recovered. Eliminating the chloride content from the rinse water prevents recycling the chloride back to the quench bath 12 and lengthens the period between shutdowns for sludge removal.

Chloride removal is preferably accomplished by electrolysis in a cell between the concentrator 22 and the melter 30 where the 50% salt solution is found. In this instance, the surge tank 27 shall be taken to represent the electrolytic cell and is equipped with a positive metal anode and a graphite cathode both of which are immersed in the 50% salt solution.

Upon attachment of the anode and cathode to a suitable source of potential, the electrolytic action produces free hydrogen at the cathode, chlorine gas at the anode, and a conversion of the sodium chloride to sodium hydroxide. The addition of nitric acid converts the hydroxide to sodium nitrate. The electrolytically converted concentrate is then pumped into the melter 30 for final concentration and returned to the quench bath 12 in the molten state.

DETAILS OF THE FLUID TRANSFER SYSTEM

The transfer of molten salt from melter 30 to quench bath 12 is preferably carried out by manual operation of pump 34 in fluid circuit 33. Assuming nitric acid rectification as set forth in Example I, this transfer is accomplished after the rectification process is completed and the temperature of the molten salt is adjusted to the temperature of the bath by suitable operation of heater 31. The readiness of the molten salt for both transfer and rectification may be indicated by a temperature sensor 35 of the immersible type which is electrically interconnected to an alarm or other suitable indicator 36.

Once transfer from melter 30 to bath 12 begins, the level of molten salt in the melter 30 begins to drop. Molten salt level is detected and monitored by immersible liquid level detector 38 which is electrically connected to a control circuit 40. When the level reaches the bottom of the longest immersible sensor, control 40 turns on pump 29 in fluid circuit 28 to transfer the 50% salt solution from the surge tank 27 to the melter 30. The liquid level detector 38 is preferably mounted in the melter 30 so as to prevent the level from dropping to the point where the heater element 31 is exposed. Once the upper level has been achieved, liquid level detector 38 operates through control 40 to turn off pump 29.

To transfer the 50% solution from concentrator 22 to surge tank 27 a temperature detector 44 is electrically interconnected to pump 46 to start the pump. It will be understood that where gravity flow is possible pumps may be replaced with simple valves to accomplish the same end result. Pump 46 may be shut off manually when concentrator 22 is nearly empty.

As the level of solution in concentrator 22 drops level detector 50 operates through control 52 to turn pump 54 on and off to maintain the proper level of solution in the concentrator 22. It will be understood that as the 20% salt solution is transferred from the surge tank 20 to the concentrator 22 the temperature drops toward the 150° F. level. Heater 23 slowly raises the temperature of the solution while agitator 24 circulates the solution to maintain temperature uniformity. As the water is evaporated off the temperature slowly rises toward the 240° F. to 250° F. range which signifies the achievement of a 50% salt solution. When this is reached, the temperature sensor 44 operates the pump 46 in the manner previously described to transfer the contents of concentrator 22 into the surge tank 27.

To maintain the operability of the counterflow rinse system, the rinse tanks 14, 16 and 18 are provided with liquid level detectors, control circuits and pumps in the interconnecting lines between rinse tanks. Specifically, rinse tank 14 is provided with liquid detector 62 operating through circuit 64 to control pump 66. Tank 16 is provided with liquid detector 68 operating through circuit 70 to control pump 72. Finally, tank 18 is provided with liquid level detector 74 operating through circuit 76 to control a valve 78 between a pressure water source and the tank 18. The result is that as each tank drops in level to a minimum the in-coming fluid circuit is actuated to restore the fluid level to the predetermined maximum. As level changes and fluid transfers are reflected back down the line the next control circuit comes into operation as will be apparent from the foregoing description.

Preferred liquid level detectors are of the fixed electrode floatless type available from B/W Controls, Inc. of 2200 East Maple Road, Birmingham, Michigan 48013. Both the liquid level detectors and the accompanying solid state control circuits are standard products of B/W Controls, Inc. and are commercially available at the present time. Similarly, pumps, alarms, and other electronic components are commercially available from a variety of sources as will be apparent to those skilled in the art. Suitable immersion heaters are available from General Electric Company; a 370 kw heater with temperature control and high temperature cut-off is suggested, although the melter may operate with a 200 kw heater having an SCR temperature control, high temperature and level cut-off and an audio visual signal.

It will be understood that the invention has been described with reference to specific illustrative embodiments and that the foregoing description is not to be construed in a limiting sense.

The embodiments of the invention in which an exclusive property or privilege is claimed are defined as follows:

1. Apparatus for the substantially continuous recycling of water-soluble quenching salts from rinse water comprising:

a heat treating bath containing a molten salt and an impurity which is sparingly soluble therein;

a rinse bath located for receiving parts from the treating bath and containing a rinse water in which both salt and impurity are soluble;

means for concentrating the rinse water/salt solution up to a predetermined concentration level;

means for treating the concentrated rinse water for the removal of said impurity; and means for returning the purified salt in a molten state to the heat treating bath.

2. Apparatus for the substantially continuous recycling of water-soluble quenching salts from rinse water comprising:

a quench bath containing a molten salt and an impurity which is sparingly soluble therein;

a rinse bath located for receiving parts from the quench bath and containing a rinse water in which both the salt and the impurity are soluble;

concentrator means connected by way of first fluid circuit means with the rinse bath for receiving rinse water therefrom and including heating means for evaporating the water;

means for treating the concentrated rinse water for the removal of the impurity; and a second fluid circuit means interconnecting the concentrator means with the quench bath for returning the purified salt thereto in a molten state.

3. Apparatus as defined in claim 2 wherein the concentrator means comprises first means for achieving a first substantial level of salt concentration in the rinse water and melter means for achieving substantially complete elimination of the water.

4. Apparatus as defined in claim 2 wherein the means for treating the concentrated rinse water comprises a tank, heater means for maintaining the concentrated rinse water at a temperature between 300° F. and 600° F., and an aqueous solution consisting of about 0.1% to 8% by weight free nitric acid, about 0.01% to about 5% by weight non-ionic surface active agent to deter foaming of the concentrate, and water.

5. Apparatus as defined in claim 2 wherein the impurity is a carbonate and wherein the means for treating the rinse water comprises:

a tank;

an aqueous solution containing a precipitant; and further comprises a filter to remove a precipitate.

6. Apparatus for the substantially continuous recycling of water soluble quenching salts from rinse water comprising:

a quench bath containing a molten salt and an impurity which is sparingly soluble therein;

a rinse bath located for receiving parts from the quench bath and containing a rinse water in which both the salt and the impurity are soluble;

a first concentrator means connected by way of first fluid circuit means to the rinse bath for receiving rinse water therefrom and including heating means for evaporating the water;

a surge tank connected to the first concentrator means by a third fluid circuit means for receiving concentrated rinse water therefrom;

means for treating the concentrated rinse water in the surge tank for removal of the impurity;

a melter unit connected to the surge tank by way of fourth fluid circuit means, for receiving a purified concentrated rinse water from the surge tank and including heating means for evaporating all remaining water therefrom; and, a second fluid circuit means interconnecting the second concentrator means with the quench bath for returning the purified salt thereto in a molten state.

7. Apparatus as defined in claim 6 wherein the impurity is a chloride and the means for treating the concentrated rinse water in the surge tank further comprises:

an anode and cathode with an attached source of potential;

a means to collect and eliminate chlorine gas formed; and an aqueous solution of nitric acid.

8. Apparatus as defined in claim 6 wherein the rinse bath further comprises:

a plurality of rinse tanks arranged seriatim through which the parts being rinsed and the rinse water move serially and countercurrently;

a plurality of interconnecting lines between the rinse tanks; and a plurality of control means such that as the level in one rinse tank falls to a lower level, rinse water is transferred from the next serial rinse tank through the interconnecting line between them.

9. Apparatus as defined in claim 8 further comprising: as the control means;

a liquid level detector;
a control circuit; and
a pump;
such that as the level in one of the rinse tanks reaches the lower level, said liquid level detector detects that event and activates said pump via the control circuit; and
as the level in the tank reaches an upper level said liquid level detector detects that event and deactivates said pump.

10. Apparatus as defined in claim 6 further comprising:
a level detector in the first concentrator means;
a pump in the first fluid circuit means;
a control circuit connecting said level detector to said pump; such that as the level detector detects a lower level in the concentrator said level detector activates, via said control circuit, said pump which pumps rinse water from the rinse bath to the first concentrator means; and as the level in the concentrator means reaches an upper level said level detector detects that level and, via said control circuit, deactivates said pump.

11. Apparatus as defined in claim 6 further comprising:
a temperature detector in the first concentrator means;
a pump in the third fluid circuit means;
a control circuit interconnecting said temperature detector and said pump;
such that as the concentrated rinse water in the first concentrator reaches a desired temperature said temperature detector detects that temperature and, via said control circuit, activates said pump.

* * * * *